US010188223B2

(12) United States Patent
Rajagopalan et al.

(10) Patent No.: US 10,188,223 B2
(45) Date of Patent: Jan. 29, 2019

(54) REFRIGERATED MERCHANDISER INCLUDING EUTECTIC PLATE REFRIGERATION

(71) Applicant: Hussmann Corporation, Bridgeton, MO (US)

(72) Inventors: Anand G. Rajagopalan, Irvine, CA (US); Jiaching Liu, Monterrey Park, CA (US)

(73) Assignee: Hussmann Corporation, Bridgeton, MO (US)

( * ) Notice: Subject to any disclaimer, the term of this patent is extended or adjusted under 35 U.S.C. 154(b) by 123 days.

(21) Appl. No.: 15/276,296

(22) Filed: Sep. 26, 2016

(65) Prior Publication Data

US 2018/0084925 A1 Mar. 29, 2018

(51) Int. Cl.

| | |
|---|---|
| ***A47F 3/00*** | (2006.01) |
| ***A47F 3/04*** | (2006.01) |
| ***F25B 25/00*** | (2006.01) |
| ***F25B 39/02*** | (2006.01) |
| ***F25B 47/00*** | (2006.01) |
| ***F25D 11/00*** | (2006.01) |

(52) U.S. Cl.

CPC ..... *A47F 3/0417* (2013.01); *A47F 3/007* (2013.01); *A47F 3/0434* (2013.01); *A47F 3/0491* (2013.01); *F25B 25/005* (2013.01); *F25B 39/02* (2013.01); *F25B 47/006* (2013.01); *F25D 11/006* (2013.01); *A47F 3/0478* (2013.01); *F25B 2400/22* (2013.01); *F25B 2400/24* (2013.01); *F25B 2700/2103* (2013.01); *F25B 2700/2104* (2013.01)

(58) Field of Classification Search

CPC ..... A47F 3/0491; F28D 2020/0013; F28D 2020/0078; F28D 2020/0008; F28D 1/0417; F25B 2400/054; F25B 11/006; F25B 25/028; F25B 2303/083–2303/0832

See application file for complete search history.

(56) References Cited

U.S. PATENT DOCUMENTS

| | | | |
|---|---|---|---|
| 1,993,328 A | 3/1935 | Ingvardsen et al. | |
| 2,405,834 A | 8/1946 | Kleist | |

(Continued)

FOREIGN PATENT DOCUMENTS

| | | | | |
|---|---|---|---|---|
| CA | 2206225 | * | 6/1996 | ..... F25B 39/02 |
| EP | 0098052 | | 1/1984 | |

(Continued)

OTHER PUBLICATIONS

International Search Report and Written Opinion for Application No. PCT/US2017/046742 dated Nov. 23, 2017 (10 pages).

*Primary Examiner* — Cassey D Bauer

(74) *Attorney, Agent, or Firm* — Michael Best & Friedrich LLP

(57) ABSTRACT

A refrigerated merchandiser includes a case having a base and a canopy at least partially defining a product display area. One or more eutectic plates are positioned in the product display area. The eutectic plates include a fluid contained in a housing. A heat exchanger including a coil is positioned in the housing to cool the fluid. The coil has an inlet, an outlet spaced from the inlet, a first portion, and a second portion adjacent and in thermal communication with the first portion to define a tube-to-tube heat exchanger.

20 Claims, 8 Drawing Sheets

(56) References Cited

U.S. PATENT DOCUMENTS

| | | | |
|---|---|---|---|
| 2,607,204 | A | 8/1952 | Kleist |
| 3,888,303 | A | 6/1975 | Skala |
| 4,103,510 | A | 8/1978 | Hall |
| 4,658,593 | A | 4/1987 | Stenvinkel |
| 4,756,164 | A | 7/1988 | James et al. |
| 5,524,453 | A | 6/1996 | James |
| 5,584,187 | A | 12/1996 | Whaley |
| 5,713,208 | A | 2/1998 | Chen et al. |
| 5,743,108 | A | 4/1998 | Cleland |
| 5,921,096 | A | 7/1999 | Warren |
| 5,931,018 | A | 8/1999 | Hall et al. |
| 6,109,337 | A | 8/2000 | Gomez |
| 6,185,951 | B1 | 2/2001 | Lane et al. |
| 6,279,333 | B1 | 8/2001 | Cilli et al. |
| 6,481,216 | B2 | 11/2002 | Simmons |
| 6,543,245 | B1 | 4/2003 | Waldschmidt et al. |
| 6,892,798 | B2 | 5/2005 | Lee et al. |
| 6,915,657 | B1 | 7/2005 | Wood |
| 7,089,756 | B2 | 8/2006 | Hu |
| 7,254,952 | B2 | 8/2007 | Lilke |
| 7,322,204 | B2 | 1/2008 | Hirao et al. |
| 7,357,000 | B2 | 4/2008 | Schwichtenberg et al. |
| 7,600,392 | B2 | 10/2009 | Williams et al. |
| 8,495,887 | B2 | 7/2013 | Smadiris et al. |
| 8,667,807 | B2 | 3/2014 | Veltrop |
| 8,726,688 | B2 | 5/2014 | Ghiraldi |
| 8,991,478 | B2 | 3/2015 | Zaffetti et al. |
| 2003/0213260 | A1 | 11/2003 | Lane et al. |
| 2005/0136160 | A1* | 6/2005 | Schwichtenberg ..... A47F 3/001 426/241 |
| 2010/0192600 | A1 | 8/2010 | Schenk et al. |
| 2010/0212343 | A1 | 8/2010 | Swofford et al. |
| 2011/0271701 | A1 | 11/2011 | Stephens et al. |
| 2013/0098075 | A1 | 4/2013 | Hegedus et al. |
| 2014/0041407 | A1 | 2/2014 | Bush |
| 2015/0143818 | A1* | 5/2015 | Eckhoff ..... F28D 15/02 62/3.2 |
| 2016/0116220 | A1 | 4/2016 | Mandelcorn et al. |
| 2016/0313046 | A1* | 10/2016 | Roekens ..... F25B 5/04 |

FOREIGN PATENT DOCUMENTS

| | | |
|---|---|---|
| EP | 1006324 | 7/2000 |
| EP | 1124101 | 8/2001 |
| WO | WO 2005075907 | 8/2005 |
| WO | WO 2006007663 | 1/2006 |
| WO | WO 2007064255 | 6/2007 |

* cited by examiner

SHELF SURFACE AT THE 10TH HOURS

| | | | | |
|---|---|---|---|---|
| 33.7 | 33.1 | 32.9 | 33.0 | 33.6 |
| 33.4 | 33.0 | 33.0 | 32.2 | 32.6 |
| 33.6 | 33.1 | 33.0 | 32.2 | 32.4 |
| 33.6 | 32.4 | 32.5 | 32.4 | 32.6 |
| 33.9 | 32.3 | 32.5 | 32.3 | 33.2 |

AVERAGE = 32.9 SPREAD = 1.7

62

DECK SURFACE AT THE 10TH HOURS

| | | | | |
|---|---|---|---|---|
| 33.9 | 33.0 | 33.4 | 33.3 | 33.6 | 34.6 |
| 31.9 | 32.1 | 32.2 | 31.9 | 31.8 | 32.7 |
| 31.9 | 32.3 | 31.8 | 31.6 | 31.9 | 32.5 |
| 33.1 | 32.5 | 32.3 | 32.4 | 32.2 | 33.8 |

AVERAGE = 32.6 SPREAD = 3.0

28

REFRIGERATED MERCHANDISER INCLUDING EUTECTIC PLATE REFRIGERATION

BACKGROUND

Various exemplary embodiments relate to a refrigeration system for a merchandiser.

Refrigeration systems are well known and widely used in supermarkets, warehouses, and other environments to refrigerate product. Conventional refrigeration systems typically include an evaporator, a compressor, and a condenser. Some merchandiser refrigeration systems are utilized to refrigerate product (e.g., meat, fish, deli product, etc.) that is sensitive to airflow. For example, existing meat and deli merchandisers typically use a linear serpentine coil that is placed at the bottom of the product display area and that conductively cools a platform (often formed of metal) on which product is supported. One difficulty with refrigeration systems using a standard serpentine coil is that it is difficult to keep a uniform surface temperature just above freezing so that the displayed products can be kept fresh for longer periods of time while also reducing the need to defrost.

SUMMARY

An exemplary embodiment includes a refrigerated merchandiser having a case including a base and a canopy at least partially defining a product display area. A eutectic plate is positioned in the product display area and includes a housing defining a hollow cavity. A fluid is contained in the housing. A heat exchanger including a coil is positioned in the housing to cool the fluid. The coil has an inlet, an outlet spaced from the inlet, a first portion, and a second portion adjacent and in thermal communication with the first portion to define a tube-to-tube heat exchanger.

Another exemplary embodiment includes a case, a eutectic deck plate, and a eutectic shelf plate. The case includes a base and a canopy at least partially defining a product display area. The eutectic deck plate is positioned above the base and includes a first housing defining a hollow cavity, a first fluid contained in the first housing, and a first heat exchanger including a first coil positioned in the first housing to cool the first fluid. The first coil has a first inlet extending from the first housing, a first outlet extending from the first housing, a first portion, and a second portion adjacent and in thermal communication with the first portion to define a first tube-to-tube heat exchanger. The eutectic shelf plate is positioned above the deck plate and includes a second housing defining a hollow cavity, a second fluid contained in the second housing, and a second heat exchanger including a second coil positioned in the second housing to cool the second fluid. The second coil has a second inlet extending from the second housing, a second outlet extending from the second housing, a third portion, and a fourth portion adjacent and in thermal communication with the third portion to define a second tube-to-tube heat exchanger.

According to another exemplary embodiment, a refrigeration system for cooling a refrigerated merchandiser includes a case containing a eutectic plate positioned in a product display area and a temperature sensor connected to the eutectic plate. The eutectic plate includes a housing defining a hollow cavity. A fluid is contained in the housing and a heat exchanger including a coil is positioned in the housing to cool the fluid. The coil includes an inlet, an outlet spaced from the inlet, a first portion, and a second portion adjacent and in thermal communication with the first portion to define a tube-to-tube heat exchanger. The temperature sensor is positioned proximate the inlet and outlet. A refrigeration system circulates a refrigerant through the heat exchanger. A controller is in communication with the temperature sensor and the refrigeration system. The controller is configured to activate the refrigeration system in response to a first temperature signal and deactivate the refrigeration system in response to a second temperature signal.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
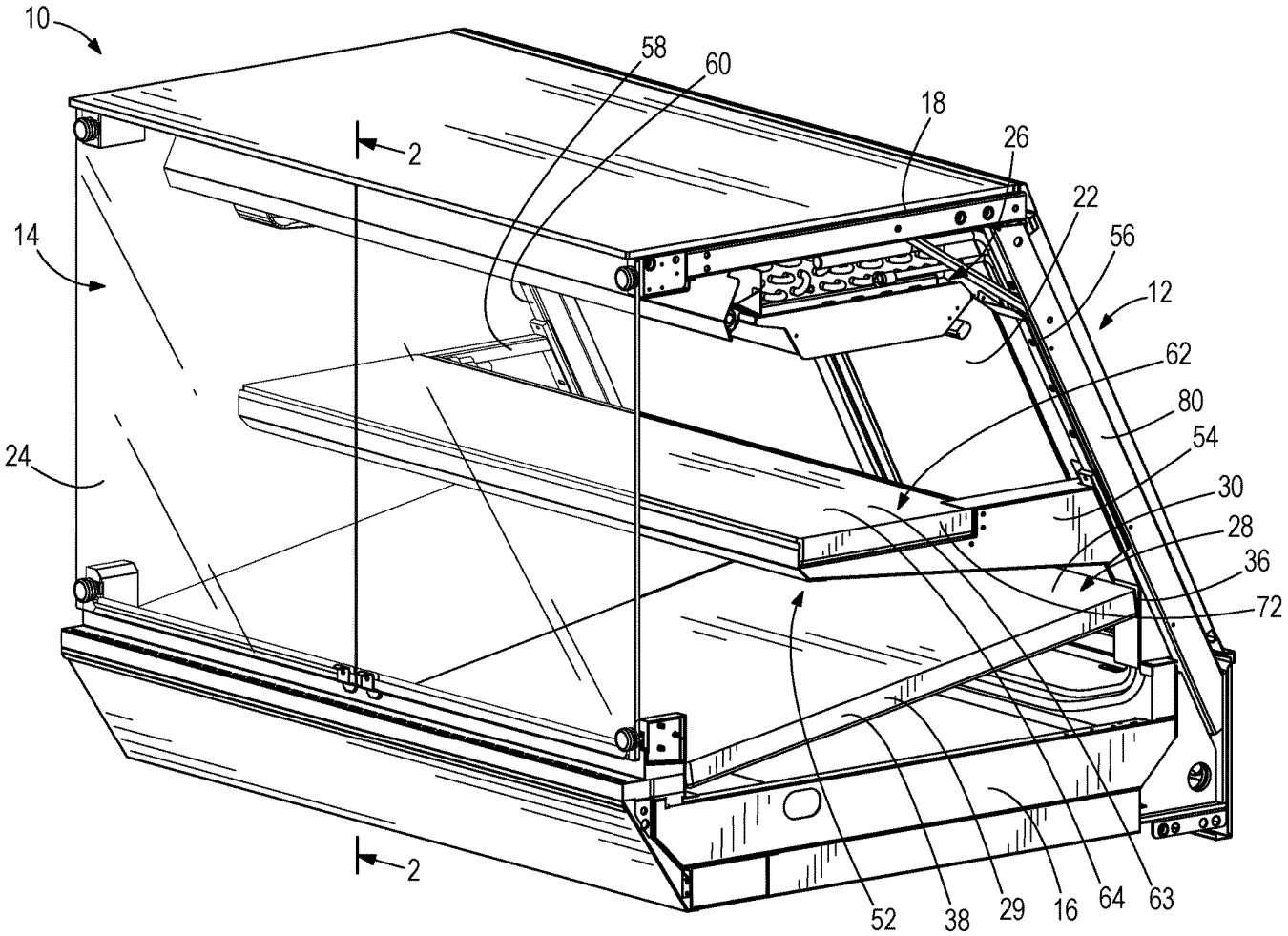
FIG. 1 is a perspective view of an exemplary merchandiser including deck plates, a shelf that supports a shelf plate, and a gravity coil disposed above the shelf.
Figure 2:
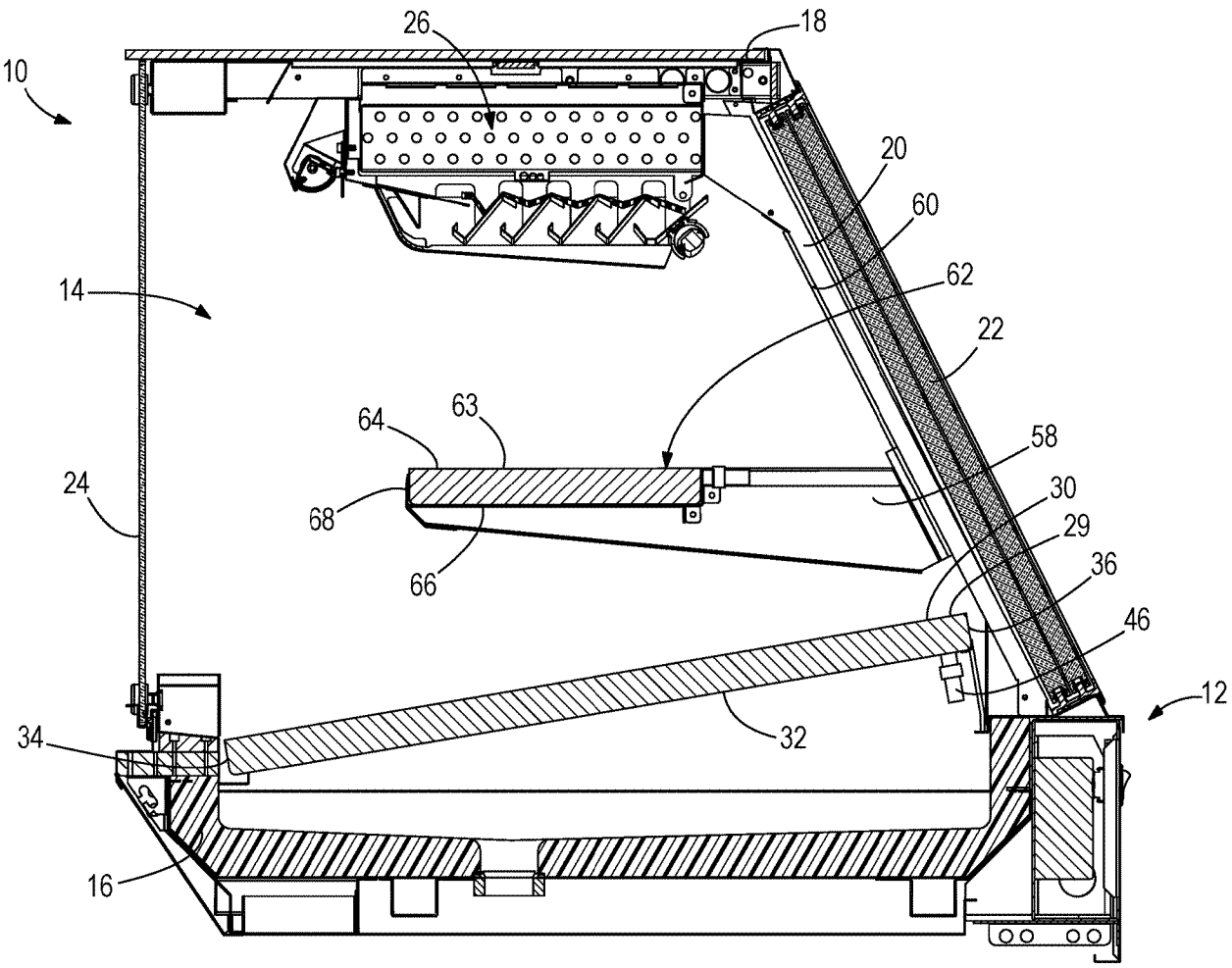
FIG. 2 is a cross-sectional view of the merchandiser of FIG. 1 taken along line 2-2.

FIGS. 1 and 2 illustrate a portion of an exemplary merchandiser that may be located in a supermarket or a convenience store or other retail settings for presenting fresh food, beverages, and other products to consumers. The illustrated merchandiser 10 is a horizontal merchandiser (e.g., a meat, fish, bakery, or deli-type merchandiser) and includes a case 12 that defines a product display area 14 in which product can be supported.

The case 12 has a base 16 and a top wall or canopy 18 that is attached to the base 16 and cantilevered over the product display area 14 via uprights 20. One or more first glass panels 22 are coupled to a rear of the case 12 between the uprights 20 to enclose the rear side of the merchandiser 10. The first glass panels 22 can be fixed to the uprights 20, or the first set of glass panels 22 can move relative to the uprights 20 (e.g., as part of one or more doors) to selectively provide access to the product display area 14 from the rear of the case 12. One or more second glass panels 24 are positioned adjacent a front edge of the case 12 to enclose the front side of the merchandiser 10. As illustrated, the second glass panels 24 (two shown) are attached to a front of the base 16 and a front of the canopy 18. The second glass panels 24 can be fixed in place (i.e. not movable), or the second glass panels 24 can move relative to the base 16 and the canopy 18 (e.g., as part of one or more moveable doors) to selectively provide access to the product display area 14 from the front of the case 12. In some embodiments, the first or second glass panels 22, 24 can be removed to provide an open-rear or open-front of the merchandiser 10.

With continued reference to FIGS. 1 and 2, the merchandiser 10 includes a gravity coil 26 that is coupled to the canopy 18 to generate a slow-moving refrigerated airflow to condition the product display area 14. The gravity coil 26 works on the principle of natural convection and provides cold dense air at low velocities which falls on the product display area. The gravity coil 26 is well known in the art and, as such, will not be described in detail.

Figure 3:
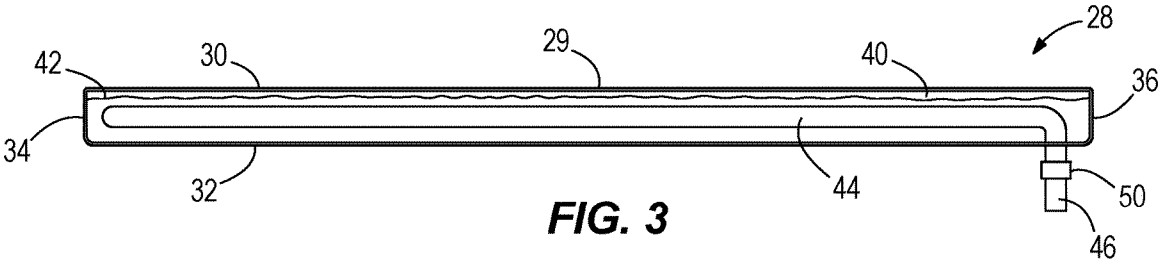
FIG. 3 is a side view of one of the deck plates of FIG. 1 with a side wall removed to expose an internal refrigeration coil.
Figure 4:
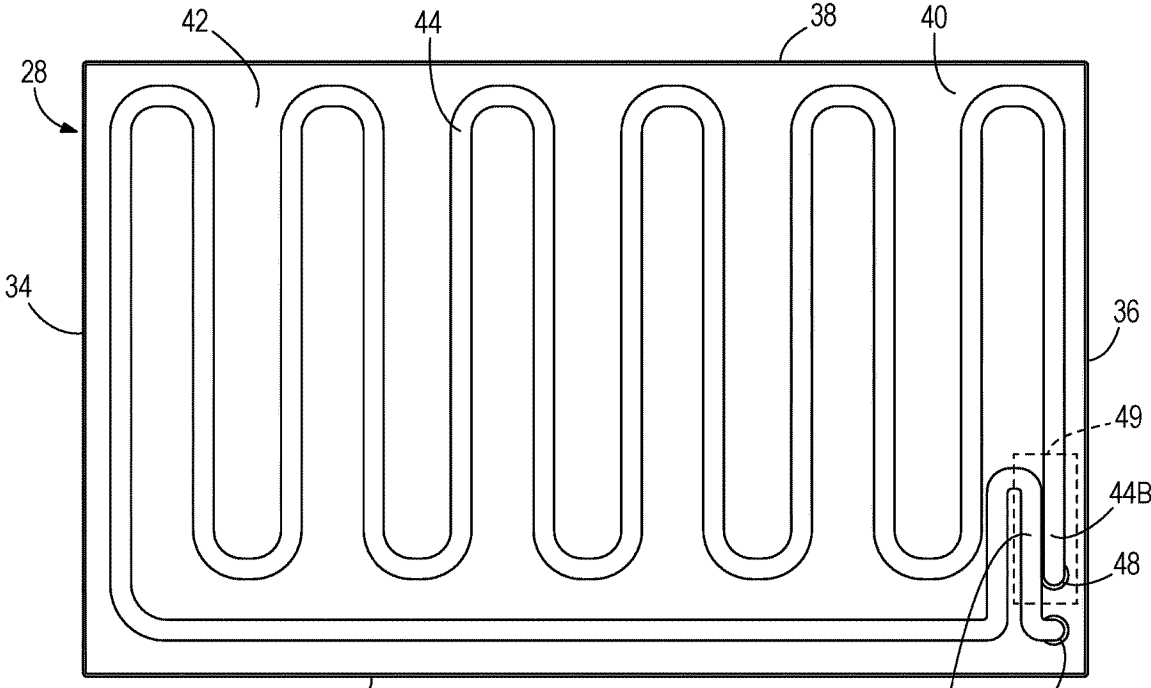
FIG. 4 is top view of the deck plate of FIG. 3 with the top wall removed to expose the interior of the housing.
Figure 5:
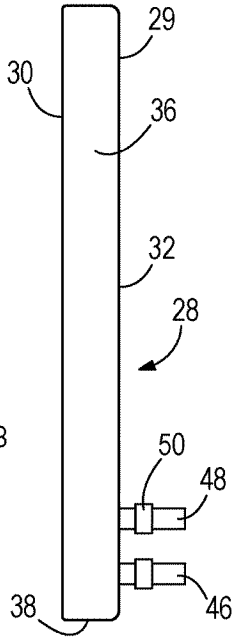
FIG. 5 is a rear view of the deck plate of FIG. 3 illustrating an inlet and an outlet of the refrigeration coil exiting the deck plate.
Figure 6:
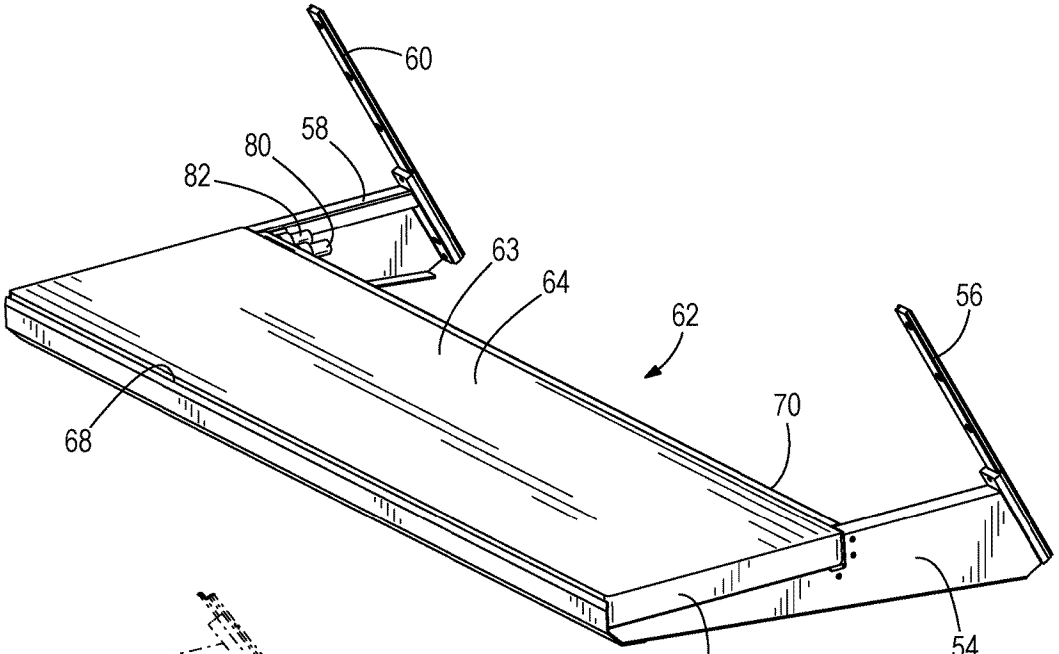
FIG. 6 is a front perspective view of the shelf and the shelf plate of FIG. 1.
Figure 7:
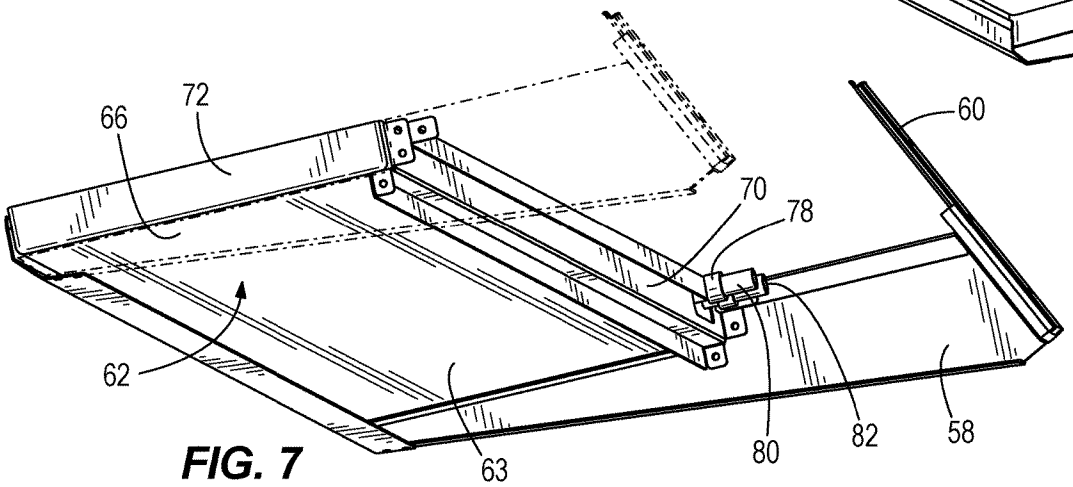
FIG. 7 is rear perspective view of FIG. 6 of the shelf and the shelf plate of FIG. 1.

As illustrated in FIGS. 1 and 2, the case 12 includes deck plates 28 (two shown) that are positioned above the base 16. As will be appreciated, the merchandiser 10 can include one or more deck plates 28 depending at least in part on the size (e.g., width or length or depth) of the merchandiser 10. The base 16 can also include insulation (not shown) below the deck plates 28. With reference to FIGS. 3-5, each deck plate 28 defines a eutectic plate that has a housing 29 with a top wall 30, a bottom wall 32, a front wall 34, a rear wall 36, and a pair of side walls 38. The housing 29 is generally rectangular (e.g., square) although other shapes are possible and within the scope of the invention. The top and bottom walls 30, 32 intersect the front and rear walls 34, 36, and the side walls 38 at substantially flush right angles without any overhang or flanges extending beyond the front and rear walls 34, 36, and the side walls 38. In some embodiments, the deck plates 28 can be made from one or more flat plates of stainless steel that have one or more welded edges. The deck plates 28 can have a flatness profile with a variation of approximately ±0.05 inches or less.

As illustrated in FIGS. 3 and 4, the deck plate 28 housing 29 has a hollow cavity 40 that contains a fluid 42. The fluid 42 can be homogenous, such as water, or a refrigerant solution or mixture. The fluid 42 is cooled to a specific temperature (e.g., frozen or unfrozen) and, after reaching the desired temperature, provides cooling directly to the product placed on or near the deck plate 28. The amount of fluid 42 contained in the housing is such that the fluid 42 fills the cavity 40 when the fluid is at or approximately at the desired temperature for the deck plate 28. For example, for a fluid 42 intended to be frozen (e.g., water), the housing 29 is initially filled with fluid 42 to a level that is less than the total volume of the cavity 40 so that the fluid 42 can expand to fill all or approximately all of the entire empty volume of the housing. In an exemplary embodiment, the fluid is water that is filled in the range of approximately 90% to approximately 93% of the empty volume of the housing.

As illustrated in FIGS. 3-5, a heat exchanger (or similar cooling component) is positioned in the hollow cavity 40 of the deck plate 28. The heat exchanger is defined by a coil 44 that has an inlet 46 and an outlet 48 extending from the deck plate 28. FIG. 4 shows the coil 44 extending from the inlet 46 to the outlet 48. In an exemplary embodiment, the inlet 46 and outlet 48 extend from a rear portion of the bottom wall 32. As illustrated, each of the inlet 46 and the outlet 48 is defined by a cylindrical conduit that has an enlarged flange 50. A refrigerant or other cooling fluid is circulated into the serpentine coil 44 through the inlet 46, and exits the coil 44 through the outlet 48 to cool the fluid 42 within the deck plate 28.

As shown in FIG. 4, the coil 44 extends from the inlet and includes a curvilinear section, a linear section positioned along one of the side walls 38 (the wall 38 shown at the bottom as viewed in FIG. 4), and then extends in a serpentine path from the front wall 34 toward the rear wall 36 and the outlet 48. As shown in FIG. 4, the outer extents of the serpentine path are disposed or positioned adjacent or in close proximity to the wall 38 (shown at the top of FIG. 4) and the linear extent adjacent the other wall 38 (shown at the bottom of FIG. 4). In some embodiments, the heat exchanger can include a micro-channel element or a non-linear spiral coil instead of, or in addition to, the coil 44 shown.

With reference to FIG. 4, the coil 44 has a first coil portion 44A (defined along part of the coil 44 adjacent and extending a short distance from the inlet 46) that is adjacent a second portion 44B (defined along part of the coil 44 adjacent and extending a short distance from the outlet 48). The first portion 44A and the second portion 44B form a tube-to-tube heat exchanger region 49 where heat is transferred via conduction through the respective portions of the wall of the coil 44 from fluid in the first portion 44A to fluid in the second portion 44B. As shown in FIG. 4, the first portion 44A is a part of a curvilinear section that extends at least partially inside a serpentine portion. The first portion 44A is separated from the second portion 44B by a certain length of the serpentine coil. For example, the first portion 44A can be within one third or less of the entire length of the coil from the inlet 46 and the second portion 44B can be within one third or less of the entire length of the coil from the outlet 48.

In the tube-to-tube heat exchanger region 49, the first portion 44A and the second portion 44B of the coil 44 can be fused together, in contact (e.g. surface-to-surface engagement), or otherwise spaced close enough to provide heat transfer between the coil portions. The tube-to-tube heat exchanger region 49 limits temperature fluctuations in the deck plate 28, for example, by reducing or eliminating a hot or warm spot at or near the outlet 48. This results in a more uniform temperature profile across the surface of the deck plate 28 and temperature stability within the deck plate 28. In some embodiments, the heat exchanger can include more than one tube-to-tube heat exchanger region 49. It will be appreciated that other coil configurations can also be used and the location and configuration of the tube-to-tube heat exchanger region 49 can be modified.

As illustrated in FIGS. 1, 2, 6, and 7, the case 12 also includes a shelf 52 that is attached to the uprights 20. The merchandiser may include none or more than one shelf 52 depending on the height of the merchandiser 10. The shelf 52 includes a first bracket 54 that is releasably connected to a first rail 56 positioned in the case 12 and a second bracket 58 releasably connected to a second rail 60 positioned in the case 12. The positions of the first and second brackets 54, 58 on the first and second rails 56, 60 can be adjusted or changed to alter the position of the shelf 52 within the product display area 14 relative to the base 16 and the canopy 18.

The first and second brackets 54, 58 support a shelf plate 62. According to an exemplary embodiment, the shelf plate 62 defines a eutectic plate that has a housing 63 with a top wall 64, a bottom wall 66, a front wall 68, a rear wall 70, and a pair of side walls 72. The top and bottom walls 64, 66 meet the front and rear walls 68, 70, and the side walls 72 at substantially flush right angles without any overhang or flanges extending beyond the front and rear walls 68, 70, and the side walls 72.

The shelf plate 62 housing 63 has a hollow cavity 74 that contains a fluid 76. The fluid 76 can be homogenous, such as water, or a refrigerant solution or mixture. The fluid 76 is cooled to a specific temperature (e.g., frozen or unfrozen) and, after reaching the desired temperature, provides cooling directly to the product placed on or near the shelf plate 62. The amount of fluid 74 contained in the housing is such that the fluid 74 fills the cavity 74 when the fluid is at or approximately at the desired temperature for the shelf plate 62. For example, for a fluid 76 intended to be frozen (e.g., water), the housing 63 is initially filled with fluid 76 to a level that is less than the total volume of the cavity 74 so that the fluid 76 can expand to fill all or approximately all of the entire empty volume of the housing. In an exemplary embodiment, the fluid 76 is water that is filled to approximately 93% of the empty volume of the housing 63.

Figures 8, 9, 10:
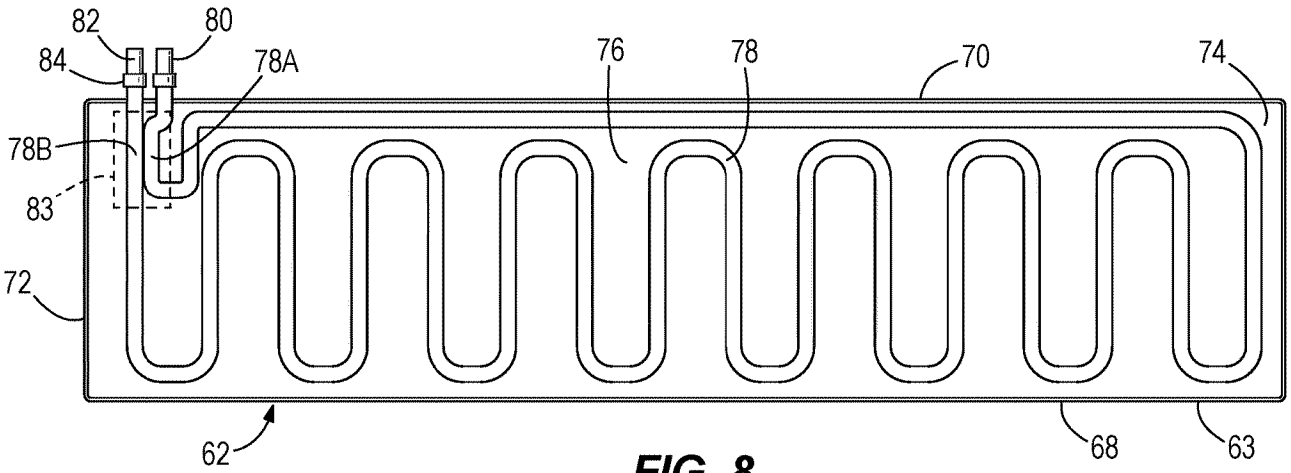
FIG. 8 is a top view of the shelf plate of FIG. 6.
FIG. 9 is a schematic illustration of exemplary temperature distribution on the deck plate.
FIG. 10 is a schematic illustration of exemplary temperature distribution on the shelf plate.

As illustrated in FIG. 8, a heat exchanger (or similar cooling component) is positioned in the hollow cavity 74 of the shelf plate 62. The heat exchanger is defined by a coil 78 that has an inlet 80 and an outlet 82 extending from the shelf plate 62. In an exemplary embodiment, the inlet 80 and outlet 82 extend from the rear wall 70. Each of the inlet 80 and the outlet 82 has a cylindrical conduit having an enlarged flange 84. A refrigerant or other cooling fluid is circulated into the inlet 80, through the coil 78, and out of the outlet 82 to cool the fluid 74 in the shelf plate 62.

As shown in FIG. 8, the coil 78 extends from the inlet 80 and includes a curvilinear section, a linear section positioned along the rear wall 70, and then extends in a serpentine path from a first sidewall 72 (shown on the fight in FIG. 8) to a second side wall 72 (shown on the left in FIG. 8) to the outlet 82. In some embodiments, the heat exchanger can include a micro-channel element or a non-linear spiral coil instead of, or in addition to, the coil 44 shown.

With reference to FIG. 8, the coil 78 has a first coil portion 78A (defined along part of the coil 78 adjacent and extending a short distance from the inlet 80) that is adjacent a second portion 78B (defined along part of the coil 78 adjacent and extending a short distance from the outlet 82). The first portion 78A and the second portion 78B form a tube-to-tube heat exchanger region 83 where heat is transferred via conduction through the respective portions of the wall of the coil 78 from fluid in the first portion 78A to fluid in the second portion 78B. As shown in FIG. 8, the first portion 78A is a part of a curvilinear section that extends at least partially inside a serpentine portion. The first portion 78A is separated from the second portion 78B by a certain length of the serpentine coil. For example, the first portion 78A can be within one third or less of the entire length of the coil from the inlet 80 and the second portion 78B can be within one third or less of the entire length of the coil from the outlet 82.

In the tube-to-tube heat exchanger region 83, the first portion 78A and the second portion 78B of the coil 78 can be fused together, in contact (e.g. surface-to-surface engagement), or otherwise spaced close enough to provide heat transfer between the coil portions. The tube-to-tube heat exchanger region 83 limits temperature fluctuations in the shelf plate 62, for example, by reducing or eliminating a hot or warm spot at or near the outlet 82. This results in a more uniform temperature profile across the surface of the shelf plate 62 and temperature stability within the shelf plate 62. In some embodiments, the heat exchanger can include more than one tube-to-tube heat exchanger region 83. It will be appreciated that other coil configurations can also be used and the location and configuration of the tube-to-tube heat exchanger region 83 can be modified.

According to various exemplary embodiments, each of the eutectic deck plates 28 and eutectic shelf plate 62 is regulated to maintain an outer surface temperature that is slightly above freezing, which helps reduce or prevent the need to defrost the plates while maintaining a suitable temperature to keep products (e.g., food) fresh. For example, the average temperature across an outer surface of each of the plates 28, 62 can be maintained in the range of approximately 32° F. to 34° F. The plates 28, 62 are cooled or refrigerated to a desired temperature via the respective heat exchangers to maintain the desired temperature range across the plates 28, 62. During a non-refrigeration phase (i.e. when no cooling or refrigeration is applied by the heat exchanger to the fluid in the plate), the temperature spread, or the difference in temperature across different regions of each the plates 28, 62 (i.e. temperature gradient across the surface of the each of the plates 28, 62) is maintained at approximately 4° F. or less for a period of time. The period of time can be two hours, five hours, ten hours, twelve hours, or, in certain conditions, 24 hours.

FIG. 9 shows an exemplary thermal map of the top surface of the deck plate 28 and FIG. 10 shows an exemplary thermal map of the top surface of the shelf plate 62 resulting from laboratory testing of the plates 28, 62 after the respective interior fluids have been frozen and the deck plate 28 and shelf plate 62 were used in a case 12 placed in an ambient environment for ten hours without additional refrigeration of cooling. As shown in FIGS. 9 and 10, each of the deck plate 28 and the shelf plate 62 keeps temperatures on their respective upper surfaces slightly above freezing. The average temperature across the deck plate is approximately 32.6° F. and the average temperature across the shelf plate 62 is approximately 32.9° F. As a result of the testing, the temperature spread for the deck plate 28 is approximately 3° F. and the temperature spread for the shelf plate 62 is 1.7° F.

Figure 11:
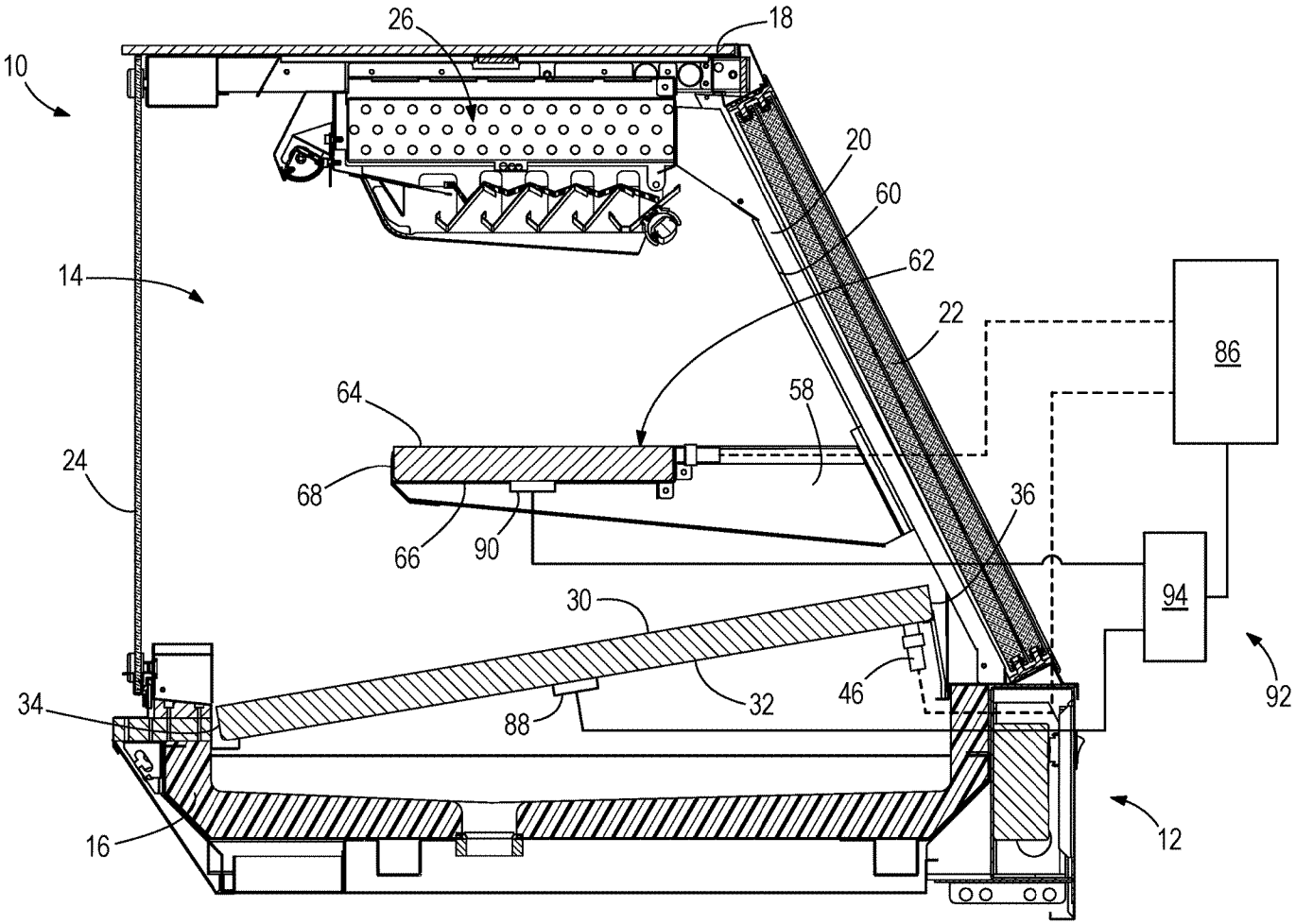
FIG. 11 is a cross-sectional view of the merchandiser FIG. 1 incorporating an exemplary cooling system and control system.
Figure 12:
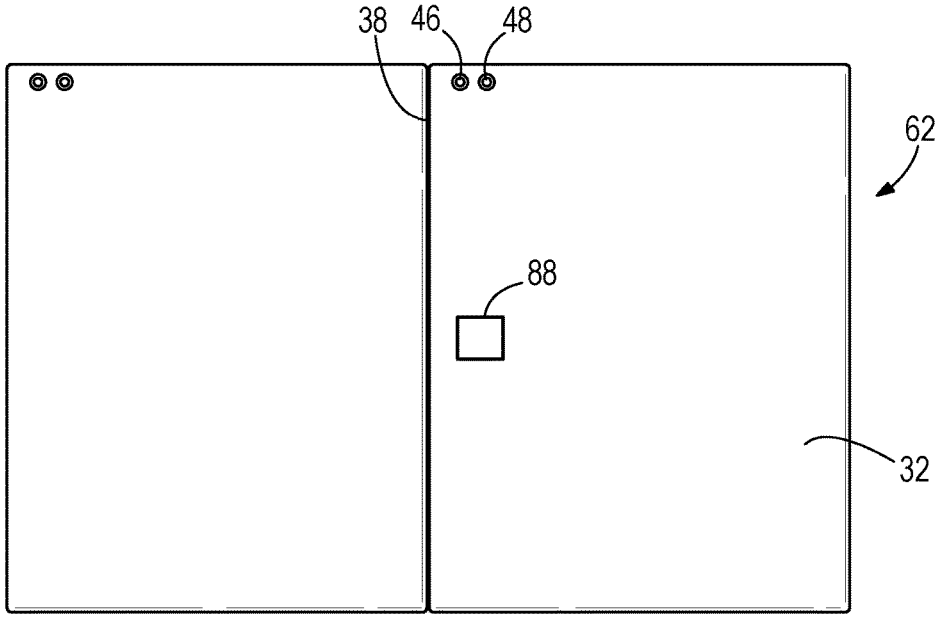
FIG. 12 is a schematic view showing a temperature sensor connected to the bottom of a deck plate.
Figure 13:
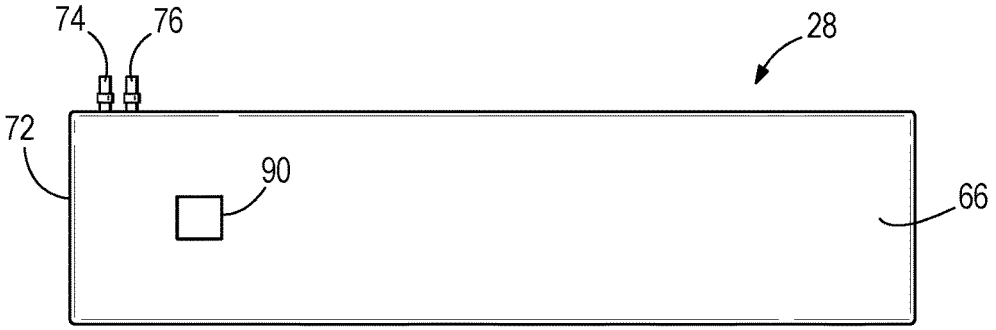
FIG. 13 is a schematic view showing a temperature sensor connected to the bottom of a shelf plate.

As illustrated in FIGS. 11-13, a cooling or refrigeration system includes the heat exchangers 44, 78 and refrigeration components 86 (e.g., compressor or pump, condenser, etc.) that are connected to the deck plate 28 and the shelf plate 62 to circulate refrigerant through the respective heat exchangers 44, 78. The refrigeration components 86 can be incorporated into the merchandiser 10 or positioned remotely form the merchandiser 10, and can include one or both of a manual cooling mode and an automatic cooling mode to maintain the plates 28, 62 within the desired temperature range. In an exemplary embodiment, the refrigeration components 86 are configured to have a different circulation path to each deck plate 28 and shelf plate 62.

In the manual cooling mode, the deck plate 28 and the shelf plate 62 are connected to a refrigeration system, for example using quick connect/disconnect lines and one or more shutoff valves. The refrigeration components 86 circulate refrigerant through the heat exchangers 44, 78 and the deck plate fluid 42 and shelf plate fluid 74 are cooled, for example until the fluids 42, 74 are frozen solid, and the flow of refrigerant is stopped. For example, the cooling system 80 can operate overnight (e.g., during times of low merchandiser engagement by a consumer or retail personnel) to freeze the fluids 42, 74. After the fluid has frozen or otherwise reached the desired temperature range, the cooling system 80 can be disconnected and the merchandiser 10 can be moved to a desired location that is remote from the cooling system 80. As the frozen fluid thaws, the deck plate 28 and the shelf plate 62 are kept cool via heat exchange between the fluid, the upper surfaces of the plates 28, 62, and the product supported on the plates 28, 62. Depending on the conditions surrounding and in the merchandiser 10, the plates can keep a desired temperature profile for up to, for example, 24 hours. In an exemplary embodiment, the fluid can remain solid for approximately 10-12 hours in Type I conditions (approximately 75° F. and approximately 55% relative humidity).

In the automatic mode, the deck plate 28 and shelf plate 62 remain connected to the cooling system 80 and the refrigerant flow to the deck plate 28 and the shelf plate 62 is turned on or off as needed by a control system 82. FIG. 11 shows an exemplary schematic of a control system 92 connected to the merchandiser 10 shown in FIG. 2. In an exemplary embodiment, the control system 82 includes a first temperature sensor 88 connected to the deck plate 28. As illustrated in FIG. 12, first temperature sensor 88 is positioned on the bottom wall 32 of the deck plate 28 in a location proximate the cooling component inlet 46 and outlet 48. For example, as shown in FIG. 12 the first temperature sensor 88 is positioned approximately along a longitudinal centerline of the deck plate 28 (e.g., extending front to back relative to the front and rear of the case 12) toward the sidewall 38 closest to the inlet 46 and outlet 48. According to various embodiments, the first temperature sensor 88 can be positioned in the half of the deck plate 28 containing the inlet 46 and outlet 48. The sensor placement may also be dependent on the temperature characteristics of the deck plate 28. For example, the first temperature sensor 88 can be positioned in a region that is the last to freeze, ensuring that the entire deck plate 28 has reached a desired temperature before cooling is deactivated. The region that is the last to freeze can be determined by taking temperature data at various points across the deck plate 28.

A second temperature sensor 90 is connected to the shelf plate 62. The second temperature sensor 90 can be positioned on the bottom wall 66 of the shelf plate 62 proximate the cooling component outlet 76. For example, as shown in FIG. 13 the second temperature sensor 90 is positioned approximately toward the sidewall 72 closest to the inlet 74 and outlet 76. The second temperature sensor 86 can be positioned in the half of the shelf plate 62 below the inlet 74 and outlet 76. The sensor placement may also be dependent on the temperature characteristics of the shelf plate 62. For example, the second temperature sensor 90 can be positioned in a region that is the last to freeze, ensuring that the entire shelf plate 62 has reached a desired temperature before cooling is deactivated. The region that is the last to freeze can be determined by taking temperature data at various points across the shelf plate 62.

The temperature sensors 88, 90 communicate with a controller 94 that is configured to start and stop the flow of refrigerant through the deck plate 28 and the shelf plate 62. The controller 94 can be incorporated into the merchandiser 10 or positioned remotely from the merchandiser 10. One example of a controller 94 is the SafeNet III controller provided by Hussmann. The temperature sensors 88, 90 monitor the respective surface temperatures of the deck plate 28 and the shelf plate 62, and the controller 94 turns the cooling system on or off to prevent frost buildup on the plates and to reduce or eliminate the need to defrost the merchandiser 10 while avoiding undesirably high product temperatures that would otherwise result from a lack of cooling from the plates 28, 62. In an exemplary embodiment, the supply of refrigerant to the deck plate 28 is initiated at approximately 33° F. and shut off at approximately 28° F., and the supply of refrigerant to the shelf plate 62 is initiated at approximately 35° F. and shut off at approximately 29° F.

Figure 14:
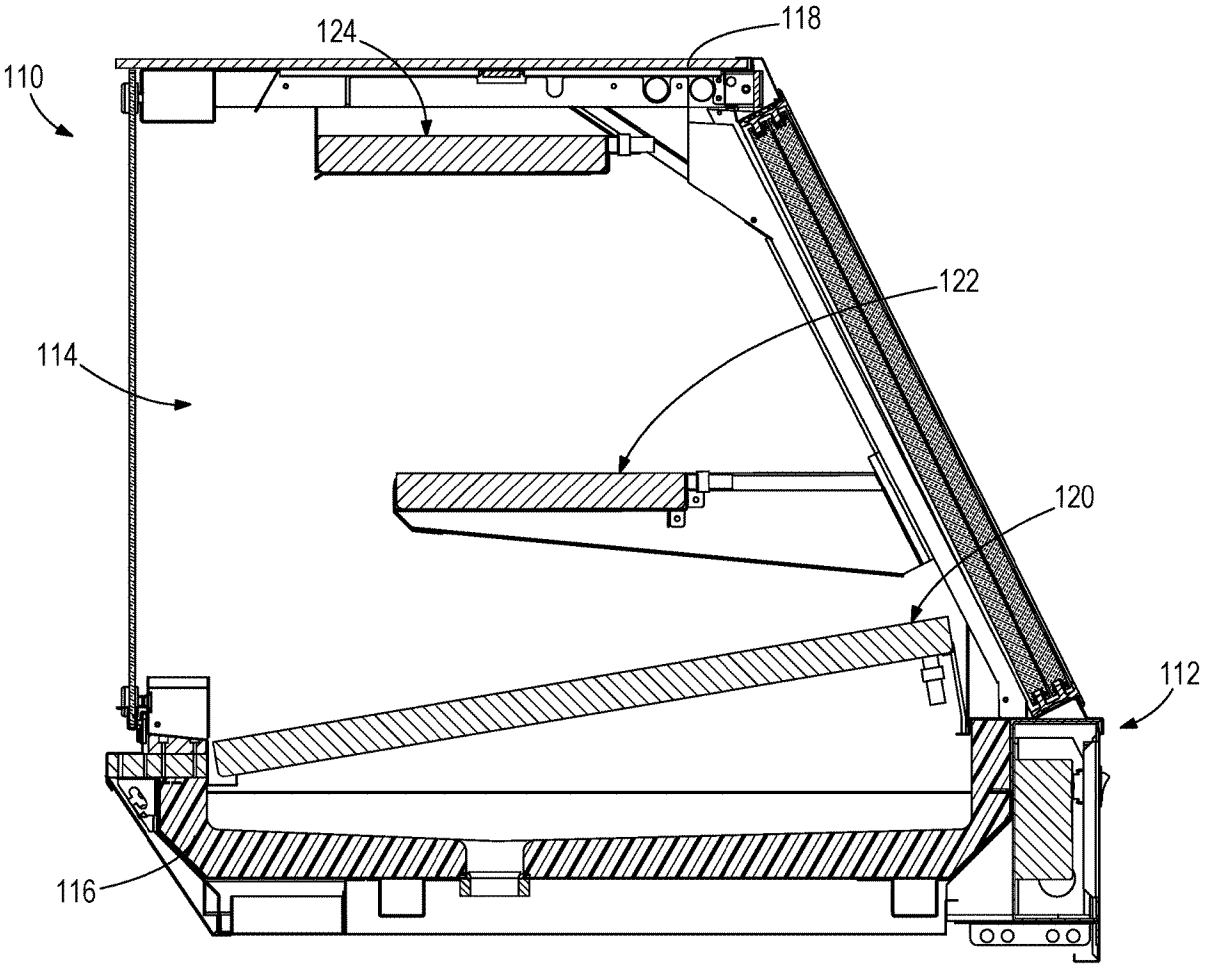
FIG. 14 is a cross-sectional view of an exemplary merchandiser having a eutectic deck plate, shelf plate, and top plate.

FIG. 14 illustrates another exemplary embodiment of a merchandiser 110 including a case 112 defining a product display area 114. The case 112 has a base 116 and a top wall or canopy 118 that is attached to the base 116. A eutectic deck plate 120 is positioned over the base 116 and a eutectic shelf plate 122 is positioned over the deck plate 120. Instead of a gravity coil, a eutectic top plate 124 is connected to the canopy 118. The eutectic top plate 124 includes a housing defining a hollow cavity (not shown) that contains a fluid (not shown) and a cooling component (not shown). The eutectic top plate 124 can include any of the features of the deck and shelf plates discussed herein, for example a serpentine coil and an inlet and outlet with a portion of the coil in thermal communication to form a tube-to-tube heat exchanger.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

Various features and advantages of the invention are set forth in the following claims.

What is claimed:

1. A refrigerated merchandiser comprising:

a case including a base and a canopy at least partially defining a product display area;

a eutectic plate positioned in the product display area and including a housing defining a hollow cavity;

a fluid contained in the housing; and a heat exchanger including a coil positioned in the housing to cool the fluid, the coil having an inlet, an outlet spaced from the inlet, a serpentine portion extending between the inlet and the outlet, a linear return portion extending adjacent an outer edge of the housing and between the serpentine portion and the outlet, the coil further including a first portion, and a second portion adjacent and in thermal communication with the first portion to define a tube-to-tube heat exchanger, wherein the second portion is positioned between the return portion and the outlet.

2. The refrigerated merchandiser of claim 1, wherein the second portion is defined by a curvilinear section that extends at least partially inside of the serpentine portion.

3. The refrigerated merchandiser of claim 1, wherein the first portion is in contact with the second portion.

4. The refrigerated merchandiser of claim 1, wherein the first portion is within one third or less of the entire length of the coil from the inlet and the second portion is within one third or less of the entire length of the coil from the outlet.

5. The refrigerated merchandiser of claim 1, wherein the housing includes walls that intersect one another at a flush joint.

6. The refrigerated merchandiser of claim 1, wherein the eutectic plate defines a deck of the merchandiser.

7. The refrigerated merchandiser of claim 1, wherein the temperature spread across an outer surface of the eutectic plate is approximately 4 degrees Fahrenheit or less.

8. The refrigerated merchandiser of claim 1, wherein the amount of fluid is at a level sufficient to expand and occupy substantially the entire empty volume of the cavity when in a frozen state.

9. The refrigerated merchandiser of claim 8, wherein the fluid is water that is filled in the range of approximately 90% to approximately 93% of the empty volume of the cavity.

10. A refrigerated merchandiser comprising:

a case including a base and a canopy at least partially defining a product display area;

a eutectic deck plate positioned above the base and including a first housing defining a hollow cavity, a first fluid contained in the first housing, and a first heat exchanger including a first coil positioned in the first housing to cool the first fluid, the first coil having a first inlet extending from the first housing, a first outlet extending from the first housing, a first portion, and a second portion adjacent and in thermal communication with the first portion to define a first tube-to-tube heat exchanger; and a eutectic shelf plate positioned above the deck plate and including a second housing defining a hollow cavity, a second fluid contained in the second housing, and a second heat exchanger including a second coil positioned in the second housing to cool the second fluid, the second coil having a second inlet extending from the second housing, a second outlet extending from the second housing, a third portion, and a fourth portion adjacent and in thermal communication with the third portion to define a second tube-to-tube heat exchanger, wherein the first portion is in direct contact with the second portion inside of the housing.

11. The refrigerated merchandiser of claim 10, wherein the third portion is part of a first serpentine portion that extends at least partially inside of a second serpentine portion.

12. The refrigerated merchandiser of claim 10, wherein the first portion is fused to the second portion.

13. The refrigerated merchandiser of claim 10, further comprising a eutectic top plate coupled to the canopy.

14. The refrigerated merchandiser of claim 10, wherein the deck plate has a flatness profile with a variation of approximately ±0.05 inches or less.

15. The refrigerated merchandiser of claim 10, further comprising a first temperature sensor coupled to the deck plate, a second temperature sensor coupled to the shelf plate, and a controller in communication with the first and second temperature sensors and a refrigeration system.

16. A refrigeration system for cooling a refrigerated merchandiser comprising:

a case containing a eutectic plate positioned in a product display area and a temperature sensor connected to the eutectic plate, the eutectic plate including a housing defining a hollow cavity, a fluid contained in the housing, and a heat exchanger including a coil positioned in the housing to cool the fluid, the coil having an inlet, an outlet spaced from the inlet, a serpentine portion extending between the inlet and the outlet, a linear return portion extending adjacent an outer edge of the housing and between the serpentine portion and the outlet, the coil further including a first portion, and a second portion adjacent and in thermal communication with the first portion to define a tube-to-tube heat exchanger, wherein the second portion is positioned between the return portion and the outlet and the temperature sensor is positioned proximate the inlet and outlet;

a refrigeration system to circulate a refrigerant through the coil; and a controller in communication with the temperature sensor and the refrigeration system, wherein the controller is configured to activate the refrigeration system in response to a first temperature signal and deactivate the refrigeration system in response to a second temperature signal.

17. The method of claim 16, wherein the first temperature signal is activated at a temperature between approximately 33° F. and approximately 35° F. and the second temperature signal is activated at a temperature between approximately 28° F. and approximately 29° F.

18. The method of claim 16, wherein the cooling system is incorporated into the merchandiser.

19. The refrigerated merchandiser of claim 1, wherein the outer edge is a rear edge of the housing.

20. The refrigerated merchandiser of claim 10, wherein the coil includes a serpentine portion extending between the inlet and the outlet, a linear return portion extending adjacent an outer edge of the housing and between serpentine portion and the outlet, and wherein the second portion is positioned between the return portion and the outlet.

* * * * *